US005826975A

United States Patent [19]

Hsieh et al.

[11] Patent Number: 5,826,975

[45] Date of Patent: Oct. 27, 1998

[54] CONVERTIBLE HALOGEN INCANDESCENT LAMP

[76] Inventors: Paul Hsieh; Shiela Hsieh, both of 18 Tiara, Irvine, Calif. 92614

[21] Appl. No.: 835,141

[22] Filed: Apr. 4, 1997

[51] Int. Cl.[6] ..... F21S 1/12

[52] U.S. Cl. ..... 362/414; 362/353; 362/431; 362/438; 362/439

[58] Field of Search ..... 362/410, 414, 362/417, 431, 437–439, 353

[56] References Cited

U.S. PATENT DOCUMENTS

| | | | |
|---|---|---|---|
| 840,586 | 1/1907 | Rech | 362/431 |
| 1,779,952 | 10/1930 | Siegel | 362/410 |
| 3,015,720 | 1/1962 | Silverman | 362/431 |
| 3,794,826 | 2/1974 | Jablonski | 362/414 |
| 4,998,193 | 3/1991 | Chuing-Hui | 362/414 |
| 5,122,942 | 6/1992 | Lee | 362/439 |
| 5,588,741 | 12/1996 | Huang | 362/438 |

*Primary Examiner*—Alan Cariaso
*Attorney, Agent, or Firm*—Walter C. Farley

[57] ABSTRACT

A lamp has a base, a pole attached to and extending upwardly from the base, a shade having a central opening, and a neck assembly at an upper end of the pole supporting the shade. The neck assembly supporting the shade includes an outer neck member with an annular bottom plate attached to the top of the pole and an upper annular support ring. An inner neck member has an annular bottom plate and an upper annular ring, the inner neck member being coaxial with the outer member and having an axial length between the bottom plate and ring less than the corresponding length of the outer member. An externally threaded body passes through the bottom plates. A nut threadedly engages the threaded body and urges the bottom plates toward each other with the upper rings engaging opposite upper and lower surfaces of the shade adjacent the central opening. A halogen or incandescent bulb socket is supported in the inner neck member. In another embodiment, the outer neck member surrounds a coaxial threaded member which carries a spacer and bracket supporting the bulb socket.

11 Claims, 5 Drawing Sheets

CONVERTIBLE HALOGEN INCANDESCENT LAMP

FIELD OF THE INVENTION

This invention relates to a lamp capable of receiving and operating with a halogen bulb or an incandescent bulb which has particularly desirable safety and convenience characteristics.

BACKGROUND OF THE INVENTION

Halogen light bulbs have been used for several years in a variety of types of lighting fixtures and have received considerable popular acceptance for several reasons including the brightness and color of the light source accompanied by the small size which permits lighting fixture designers considerable freedom to use designs which would have been impossible with core conventional incandescent bulbs. In addition, the bulbs are reasonably efficient.

In one form of lighting fixture application, a bulb is mounted at the upper end of a tall, slender shaft and surrounded by a shade which typically has a rather conical shape, opening upwardly, so that the light from the bulb is directed primarily toward a ceiling or the upper surfaces of walls. The shade may also be translucent so that a portion of the light passes through. Such lamps, commonly known as "torchère" lamps, thus produce a pleasing, indirect light. The word "torchère" was apparently adopted from French.

However, when a halogen bulb is used in such a lamp, it is possible for safety problems to arise. Halogen bulbs which have been used in this fashion can become very hot and, if an adjacent drape or curtain accidentally blows or is placed across the top of the shade near the bulb, it can quickly ignite, starting a serious fire. A recent article in the Washington Post (Washington Home, Mar. 6, 1997) mentions that a 300 watt halogen bulb can reach temperatures up to nearly 1,000° F. and briefly describes safety guidelines issued by Underwriters Laboratories to combat the problem.

The typical halogen bulb which has been used in such lamps and which causes the high temperatures leading to the problems discussed above is a rather small quartz-envelope bulb having terminals at opposite ends. The bulb is inserted into a special, two-terminal holder and must be handled with great care.

SUMMARY OF THE INVENTION

An object of the present invention is to provide a lamp construction which is adapted to receive a safer form of halogen bulb which is interchangeable with an incandescent bulb, should the owner wish to make such a change, and which is safe and convenient to use.

Briefly described the invention comprises a lamp having a base, a pole attached to and resting on the base and extending upwardly therefrom, a shade having a central opening, and a neck assembly supported at an upper end of said pole including means for supporting the shade. A light source for emitting light toward the shade is mounted in the neck assembly. The means for supporting the shade includes an outer neck member having a central axis, a first annular bottom plate, a first upper annular support ring and means interconnecting the plate and support ring, the outer neck member being mounted on an upper end of the pole. An inner neck member has a second annular bottom plate, a second upper annular ring and means for interconnecting the second bottom plate and annular ring, the inner neck member having a central axis aligned with the central axis of the outer neck member and having an axial length between the bottom plate and ring less than the corresponding length of the outer member. An externally threaded body passes through the first and second bottom plates. A threaded nut threadedly engages the threaded body and urges the bottom plates toward each other with the first and second rings engaging opposite surfaces of the shade adjacent its central opening.

In another aspect, the invention comprises a lamp having a base, a pole attached to and resting on the base and extending upwardly, and a shade having a central opening. A light source, such as a halogen bulb, is provided for emitting light toward the shade. A neck assembly is supported at an upper end of the pole and has means for supporting the shade and the socket assembly including an outer neck member having a central axis, an annular bottom plate and an upper annular support surface supporting the shade, means for mounting said outer neck member on an upper end of the pole, an inner neck member having an externally threaded body mounted on the upper end of the pole and passing through the bottom plate, the inner member having a central axis aligned with the central axis of the outer neck member and having an axial length between the bottom plate and ring greater than the corresponding length of the outer neck member. A spacer is attached to an upper end of the inner neck member and has a lower plate and an upper mounting bracket, the socket being attached to and supported by the bracket.

BRIEF DESCRIPTION OF THE DRAWINGS

In order to impart full understanding of the manner in which these and other objects are attained in accordance with the invention, a particularly advantageous embodiment thereof will be described with reference to the following drawings, which form a part of this disclosure, and wherein.

DESCRIPTION OF THE PREFERRED EMBODIMENTS

Figure 1:
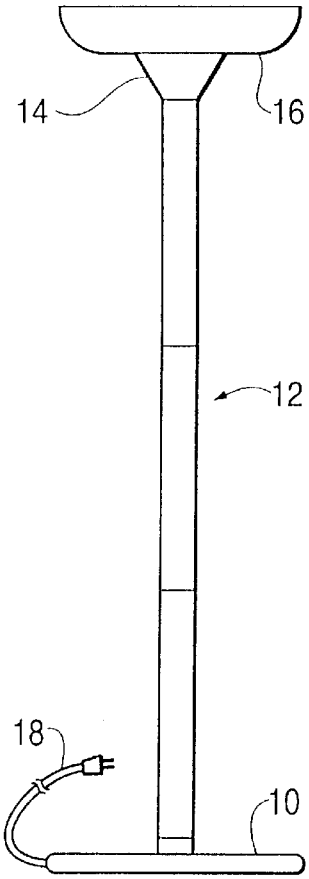
FIG. 1 is a partially foreshortened side elevation of a torchère lamp in accordance with the invention.

FIG. 1 is a side elevation of a torchère lamp in accordance with the invention. In this overall view of the lamp it is possible to recognize a base 10, a tubular pole 12, a neck 14 and a generally circular shade 16. Base 10 can be of various shapes and materials but must be sufficiently heavy to lend stability to the lamp which is typically about 6 to 8 feet tall. As mentioned above, shade 16 can be opaque or partially translucent and can also have various shapes. Conventional electrical wires 18 terminating at a plug 19 extend through the pole from the base to the neck to energize the lamp. The connection at the top will be described hereinafter.

Figure 3:
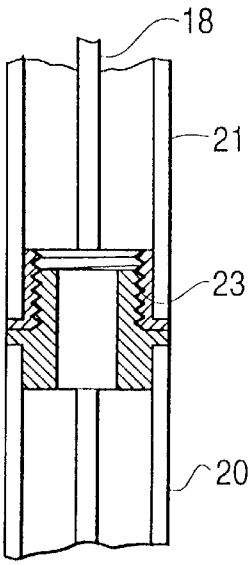
FIG. 3 is a partial sectional view of a portion of the pole of FIG. 2.
Figure 2:
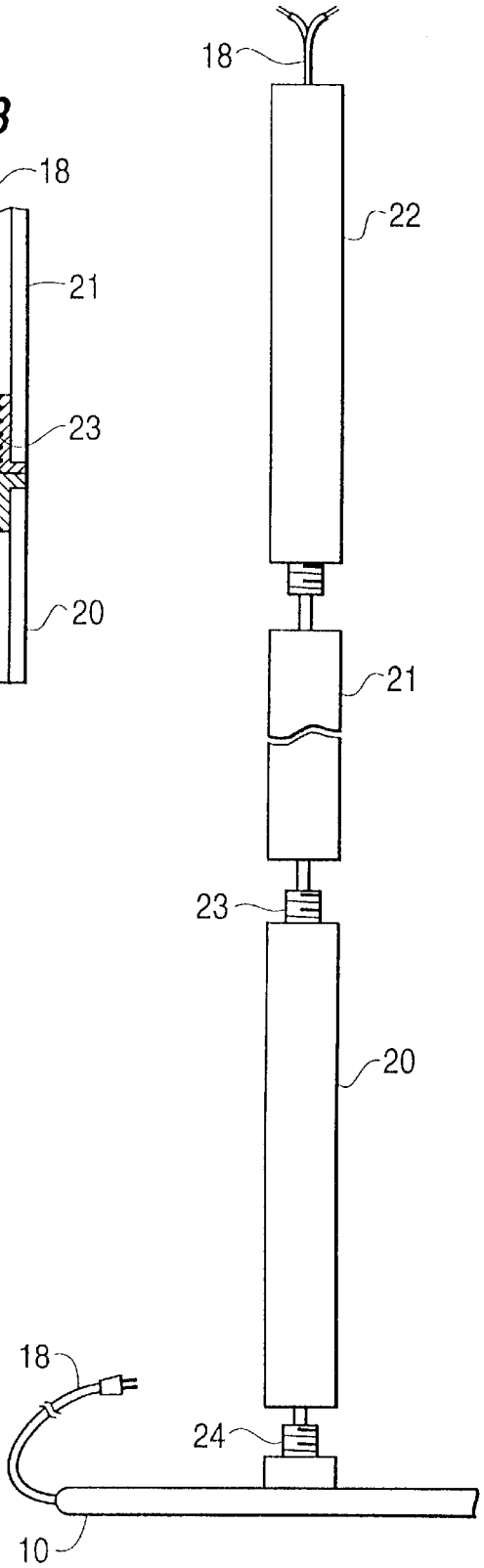
FIG. 2 is a partially exploded and foreshortened side elevation of a pole portion of the lamp of FIG. 1.

It will be noted that pole 12 is made in three sections 20, 21 and 22 which are shown in a separated state in FIG. 2 with the base but without the neck assembly or shade. As seen in FIG. 3, pole section 20 is provided at its upper end with an axially protruding, externally threaded nipple 23 and pole section 21 has an internally threaded socket 26 to threadedly receive nipple 23, securely connecting sections 20 and 21 together. The base has a similar externally threaded nipple 24 extending upwardly from the center thereof. The lower end of section 20 is also provided with an internally threaded socket to threadedly engage the external threads of nipple 24 so that the base and section 20 can be securely connected together by this threaded connection. Nipples 23 and 24 as well as their mating sockets are hollow to permit passage of wires 18 through the pole.

In a similar fashion, the upper end of section 21 also has a sockets like socket 26 to receive a threaded nipples at the lower end of section 22. It is not necessary that all of the nipple and socket connections be the same size. The nipple and socket bodies are shown with radial flanges but these are not necessary and are often undesirable for reasons of appearance. Instead, the threaded bodies can simply be dimensioned to make a very snug fit and can be forced into the ends of the pole sections.

To assemble the pole portion of the lamp, the base is placed on a stable surface and the socket of section 20 is threaded onto nipple 24 and snugly tightened. Pole section 21 is then threaded onto nipple 23 and snugly tightened and section 22 is threaded onto section 21 and tightened. The neck assembly and shade are then installed.

A dimmer control, on-off switch or other switch can be incorporated in the top pole section, for example, an connected into wires 18 in a conventional fashion.

Figure 4:
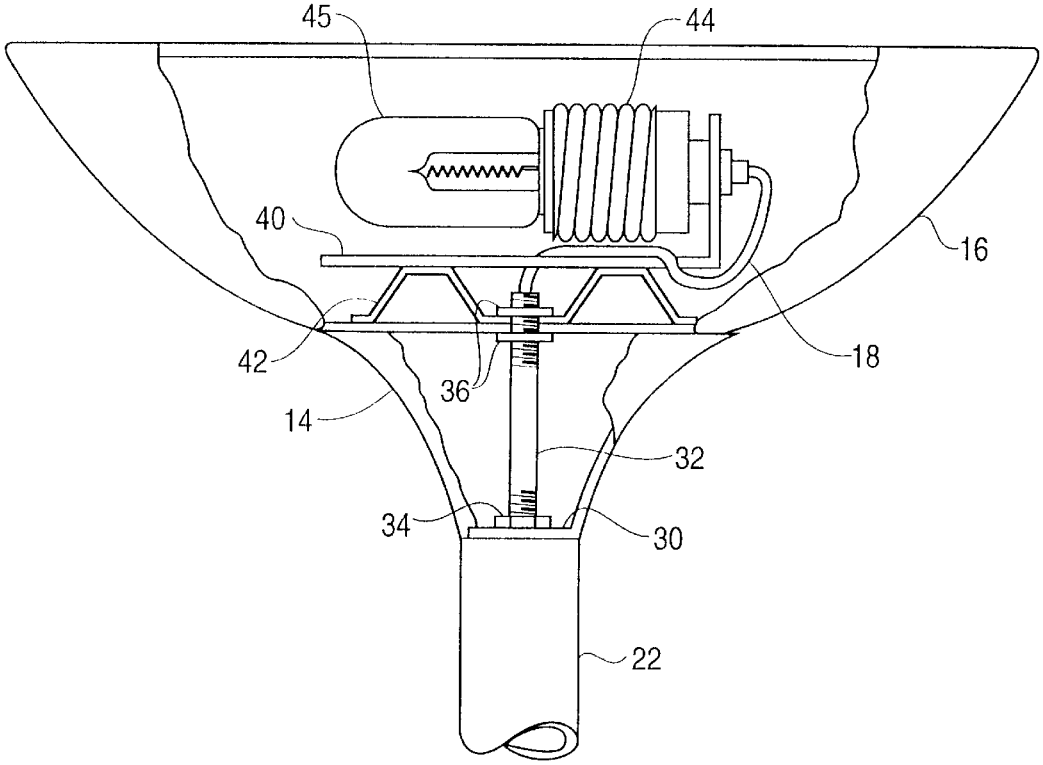
FIG. 4 is a partly cutaway side elevation of the top portion of a lamp in accordance with the invention having a lamp in a generally horizontal orientation.
Figure 5:
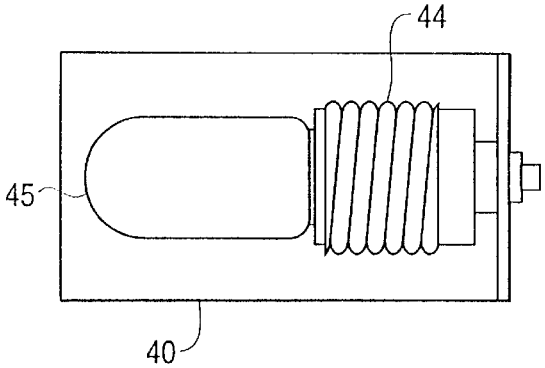
FIG. 5 is a top plan view of a bulb support and socket usable in the lamp of FIG. 4.

FIGS. 4 and 5 show in more detail the neck portion of the lamp and its relationship to the bulb socket and shade. In this embodiment, the bulb is mounted with its central axis substantially horizontal. Neck 14 comprises a decorative shell which is conical in the embodiment shown but which can have other shapes and which extends between shade 16 and the upper end of pole section 22, the shell having a lower end 30 with a central opening through which a nipple 32 extends, lower end 30 being held against section 22 by a nut 34. Nipple 32 also passes through an opening in the center of shade 16 and holds the shade with two nuts 36. Wires 18 pass through the nipple and emerge inside of shade 16.

An L-shaped mounting bracket 40 is fixedly attached to a spacer 42 as by welding or the like, the central part of the spacer being held against the shade by nuts 36 and nipple 32 which passes through a hole in the spacer. Bracket 40 has a horizontal portion and a vertical end portion. A bulb socket 44 is mounted in an opening through the vertical end portion of bracket 40 by a nipple 41, the socket being selected to receive a halogen bulb 45 or an incandescent bulb with a type A base. Wires 18 are connected to the socket. As best seen in FIG. 5, the horizontal portion of bracket 40 is about twice as wide as the diameter of the halogen bulb. The bracket is made of a reflective material such as aluminum or stainless steel and acts as a heat reflector to direct heat away from the shade and neck shell 14, either or both of which can be made of a plastic material.

The embodiment shown in FIGS. 4 and 5 is advantageously used with a JDD-250 watt halogen bulb although other wattages can be used. A different type of halogen bulb having an E-27 socket base can also be used. As illustrated, the bulb has a double envelope and a type A screw base and is much safer than earlier halogen bulbs because the outer envelope temperature is only about 30% of the temperature of previously used halogen bulbs. The risk of fire or other injury is therefore greatly reduced, although one must nevertheless exercise care when replacing the bulb, as with any lighting device.

In the assembly of the neck assembly and shade of FIGS. 4 and 5, nipple 32 is threaded into the socket at the end of pole section 22. Neck member 14 is inserted over nipple 32 and is secured by tightening nut 34. Shade 16 is then placed on the upper end of neck member 14 and the bulb is electrically connected to the bulb socket. Mounting bracket and spacer 40, 42 are then put on the nipple with nuts 36 above and below the bottom part of the spacer, nuts 36 being adjusted so that the spacer is adjacent, but not exerting excessive pressure on, the inner surface of the shade.

Figure 6:
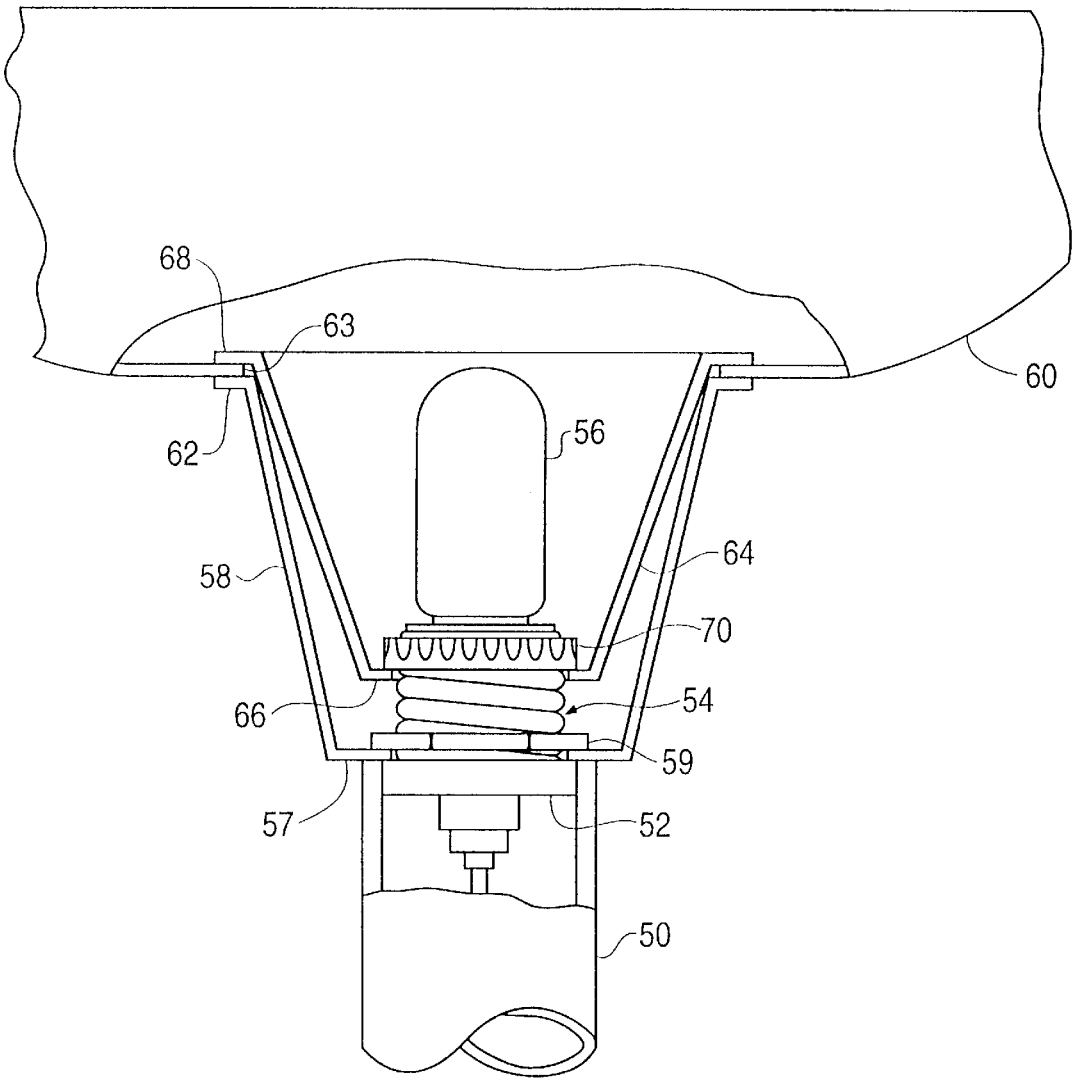
FIG. 6 is a partly cutaway side elevation of the top portion of a lamp in accordance with the invention having a bulb in a generally vertical orientation.

FIG. 6 shows an embodiment of a lamp in which the bulb socket is supported with its central axis vertical. Only the top portion of the lamp is shown, the bottom portion of the pole and the base being substantially as previously described. A pole 50 receives a base portion 52 of a socket assembly 54 which has a threaded outer surface and a threaded socket to receive a bulb 56. The upper end of pole 50 supports a neck assembly including a substantially flat bottom plate 57 of a generally conical outer neck member 58 which is held against the top of the pole and to the socket assembly by a nut 59. Neck member 58 can be made of metal or a relatively sturdy plastic and is sufficiently strong to support a shade 60. For this purpose, an upper open end of neck member 58 is formed with a radially outwardly extending ring flange 62 which abuts a lower surface of the shade around a central opening 63 which passes through the shade.

An inner neck member comprises a generally conical clamp and reflector 64 having a flat bottom plate 66 with a central opening dimensioned to surround socket assembly 54 and having a radial ring flange 68 which is dimensioned to rest on the inner surface of shade 60 above flange 62 of neck member 58 so that the periphery of the shade around opening 63 is sandwiched between flanges 68 and 62. A nut 70 is threaded onto socket assembly 54 until it presses downwardly against the inner surface of plate 66, thereby urging the bottom plates toward each other and providing a clamping force to grasp the shade between the flanges.

Figure 7:
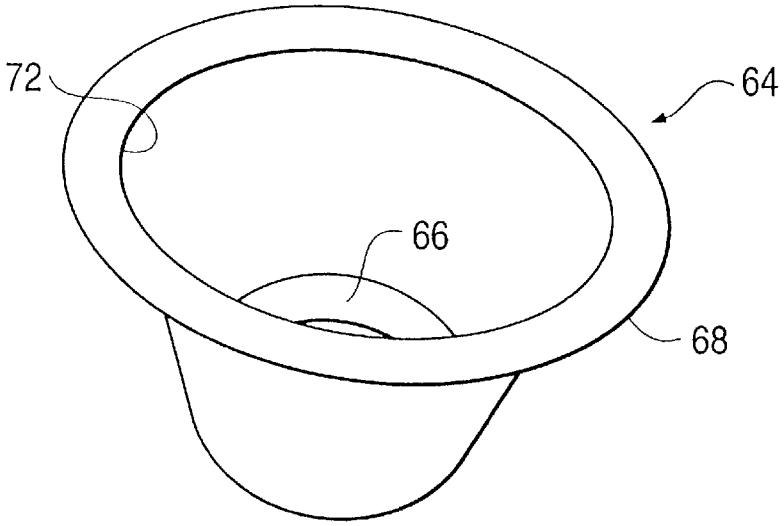
FIGS. 7 and 8 are perspective views of reflector and shade support structures in accordance with the invention.
Figure 8:
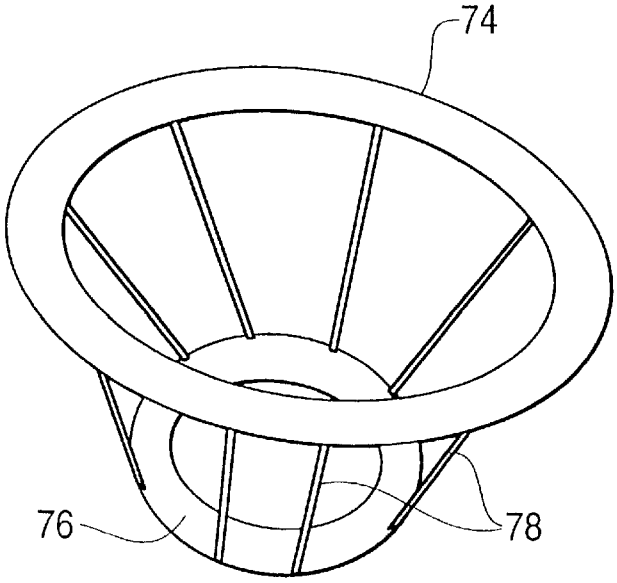

FIGS. 7 and 8 illustrate two ways of making clamp and reflector 64. In the embodiment of FIG. 7, the reflector is formed as an extruded, drawn or otherwise shaped body of aluminum or the like having an upper flange 68 and a lower flange 66 as previously described. Between those flanges is a substantially continuous frusto-conical body 72, the inner surface of which is reflective to whatever degree is desired for the lighting effect to be achieved, and to reflect heat from the bulb generally upwardly.

The embodiment of FIG. 8 comprises an upper flat, annular ring 74 and a smaller lower annular ring 76, corresponding respectively to flanges 68 and 66. Rings 74 and 76 are interconnected by a plurality of rod or wire segments 78 which are of substantially equal length and the ends of which are securely welded, brazed or soldered to the rings, thereby forming a basket-like arrangement. It will be apparent that the embodiment of FIG. 8 cannot function significantly as a reflector. However, it is capable of performing the clamping function described above in lamp structures which do not require a reflector and can permit air flow for cooling.

Figure 9:
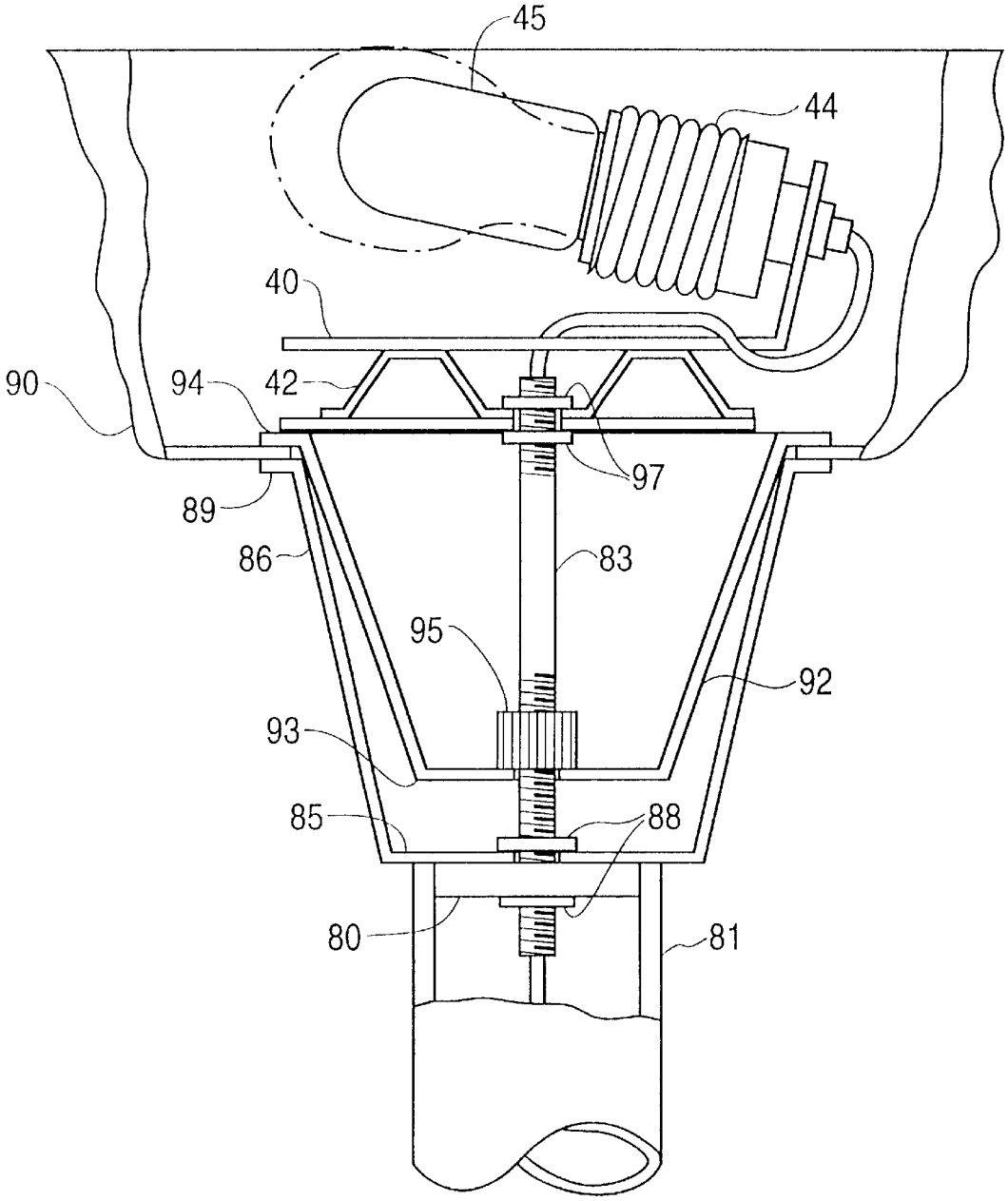
FIG. 9 is a partial and partially cutaway side elevation of a further embodiment of a lamp in accordance with the invention having a bulb in a generally horizontal orientation.

It will be recognized that the shade supporting means shown in FIG. 6 can also be used in conjunction with means for supporting a bulb in a generally horizontal orientation. This is schematically illustrated in FIG. 9. As shown therein, a plug 80 is inserted into the upper end of a pole 81, the plug having a central opening which receives an externally threaded nipple 83. A flat bottom 85 of an outer neck member 86 has a central opening through which the nipple passes, neck member 86 and the nipple being secured against the top of pole 81 and plug 80 by two nuts 88.

In a manner similar to FIG. 6, the outer neck member has a radially outward flange 89 on which rests a bottom surface of a marginal area around a central opening in a shade 90. An inner neck member 92 has a bottom portion 93 with a central opening through which nipple 83 passes and also has a flange 94 which rests on an upper surface of the marginal area supported by flange 89. The bottom 93 of neck portion 92 is urged downwardly by a nut 95 threaded onto nipple 83, thereby clamping the shade between flanges 89 and 94.

At the upper end of nipple 83 is a spacer and reflector assembly 42, identical with that of FIG. 4, held by nuts 97. The spacer also has a reflector 40, as in FIG. 4, which supports a socket 44 to receive a bulb 45. It will be noticed that reflector 40 in FIG. 9 is bent to form an angle larger than 90°, thereby providing greater clearance for a bulb, such as an incandescent bulb 98, shown in phantom lines, having a greater diameter than bulb 45. The same adjustment can be made to the structure of FIG. 4 with no other structural changes.

While certain advantageous embodiments have been chosen to illustrate the invention, it will be understood by those skilled in the art that various modifications can be made therein without departing from the scope of the invention as defined in the appended claims.

What is claimed is:

1. A lamp comprising a base;

a pole attached to and resting on said base and extending upwardly therefrom;

a shade having a central opening;

a neck assembly supported at an upper end of said pole comprising means for supporting said shade; and light source means for emitting light toward said shade, said light source means comprising a socket assembly supported on said pole top for receiving a screw-base bulb;

said means for supporting said shade comprising an outer neck member having a central axis, a first annular bottom plate, a first upper annular support ring and means interconnecting said first annular bottom plate and said upper annular support ring, means for mounting said outer neck member on said upper end of said pole;

an inner neck member having a second annular bottom plate, a second upper annular ring and means for interconnecting said second bottom plate and said second upper annular ring, said inner neck member having a central axis aligned with said central axis of said outer neck member and having an axial length between said second bottom plate and said ring less than said second annular of said outer an axial length neck member, an externally threaded body passing through said first and second bottom plates, and nut means for threadedly engaging said threaded body and urging said first and second bottom plates toward each other with said first and second rings engaging opposite surfaces of said shade adjacent said central opening thereof.

2. A lamp according to claim 1 wherein said socket assembly is mounted to hold a central longitudinal axis of said bulb generally vertically.

3. A lamp according to claim 1 wherein said socket assembly is mounted to hold a central longitudinal axis of said bulb generally horizontally.

4. A lamp according to claim 1 wherein said bulb is a halogen bulb.

5. A lamp according to claim 1 wherein said bulb is an incandescent bulb.

6. A lamp according to claim 1 wherein said pole comprises a plurality of separable sections and threaded means at ends of said sections for joining said sections to each other, said sections each having a hollow passage therethrough for receiving electrical wires.

7. A lamp comprising a base;

a pole attached to and resting on said base and extending upwardly therefrom;

a shade having a central opening;

light source means for emitting light toward said shade, said light source means comprising a socket assembly for receiving a screw-base bulb;

a neck assembly supported at an upper end of said pole comprising means for supporting said shade and said socket assembly, said means for supporting said shade comprising an outer neck member having a central axis, an first annular bottom plate and an upper annular support surface supporting said shade, means for mounting said outer neck member on said upper end of said pole, an inner neck member comprising an externally threaded body mounted on said upper end of said pole and passing through said bottom plate, said inner member having a central axis aligned with said central axis of said outer neck member and having an axial length between said bottom plate and ring greater than an axial length of said outer neck member, and spacer means attached to an upper end of said inner neck member and comprising a lower plate and an upper mounting bracket, said socket being attached to and supported by said bracket.

8. A lamp according to claim 7 wherein said socket assembly is mounted to hold a central longitudinal axis of said bulb generally horizontally.

9. A lamp according to claim 7 wherein said bulb is a halogen bulb.

10. A lamp according to claim 7 wherein said bulb is an incandescent bulb.

11. A lamp according to claim 7 wherein said pole comprises a plurality of separable sections and threaded means at ends of said sections for joining said sections to each other, said sections each having a hollow passage therethrough for receiving electrical wires extending from said base to said socket.

* * * * *